US007392800B1

(12) United States Patent
Takakura et al.

(10) Patent No.: US 7,392,800 B1
(45) Date of Patent: Jul. 1, 2008

(54) FUEL VAPOR TREATMENT

(75) Inventors: Shinsuke Takakura, Kariya (JP); Masao Kano, Gamogori (JP); Noriyasu Amano, Gamagori (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 0 days.

(21) Appl. No.: 12/000,264

(22) Filed: Dec. 11, 2007

(30) Foreign Application Priority Data

Dec. 13, 2006 (JP) ..... 2006-336152

(51) Int. Cl.
*F02M 33/04* (2006.01)

(52) U.S. Cl. ..... 123/698; 123/520

(58) Field of Classification Search ..... 123/519, 123/520, 698
See application file for complete search history.

(56) References Cited

U.S. PATENT DOCUMENTS 5,497,757 A * 3/1996 Osanai ..... 123/698
6,152,116 A * 11/2000 Duty ..... 123/520
6,971,375 B2 12/2005 Amano et al.
7,302,933 B2 * 12/2007 Kerns ..... 123/520
2004/0261765 A1 * 12/2004 Osanai ..... 123/520
2005/0056262 A1 * 3/2005 Osanai ..... 123/520
2006/0042605 A1 3/2006 Amano et al.

FOREIGN PATENT DOCUMENTS

JP 6-101534 4/1994

* cited by examiner

*Primary Examiner*—Erick Solis
(74) *Attorney, Agent, or Firm*—Nixon & Vanderhye PC

(57) ABSTRACT

A fuel vapor treatment system includes a canister containing an adsorbent, a detector detecting a concentration of a fuel vapor, a purge passage for introducing the mixture gas into an engine, and an ECU which controls a purge based on a detected fuel vapor condition quantity and learns a fuel vapor concentration. If a difference between a learned concentration and a detection concentration is not less than a specified value, the ECU performs a purge control based on the learned concentration prior to a purge control based on the detection concentration.

14 Claims, 8 Drawing Sheets

FUEL VAPOR TREATMENT

CROSS-REFERENCE TO RELATED APPLICATION

This application is based on Japanese Patent Application No. 2006-336152 filed on Dec. 13, 2006, the disclosure of which is incorporated herein by reference.

FIELD OF THE INVENTION

The present invention relates to a fuel vapor treatment system in which injected fuel and fuel vapor are combusted in an internal combustion engine.

BACKGROUND OF THE INVENTION

A fuel vapor treatment system is well known. In the fuel vapor treatment system, fuel vapor generated in a fuel tank is temporarily adsorbed by a canister, and a mixture gas of desorbed fuel vapor and air is purged into an internal combustion engine to be combusted. JP-6-101534A shows a fuel vapor treatment system in which a fuel vapor concentration of the mixture gas purged through a purge passage is detected as a fuel vapor condition quantity such that an exhaust gas air-fuel ratio during purging is precisely controlled.

In the fuel vapor treatment system shown in JP-6-101534A, when the mixture gas flows through the purge passage, the fuel vapor concentration can be detected. Hence, in order that the detected fuel vapor concentration is reflected to the air-fuel control from a beginning of starting the purge, it is necessary that the fuel vapor concentration is detected before the purged mixture gas reaches a fuel injection position of the engine. However, in a case that a volume of an intake passage from an outlet of the purge passage to the fuel injection position is small, or in a case that velocity of intake air in the intake passage is high, the mixture gas reaches the fuel injection position before the fuel vapor concentration is detected. This deteriorates an accuracy of air-fuel control.

JP-2006-161795A (U.S. Pat. No. 6,971,375B2) shows a fuel vapor treatment system in which fuel vapor desorbed from the adsorbent is mixed with air, and the mixture gas is introduced into a detection passage to detect a fuel vapor concentration of the mixture gas. In this fuel vapor treatment system, since the fuel vapor concentration is detected before starting the purge, a large quantity of purge can be achieved by reflecting the detected result to the air-fuel ratio control from a beginning of the purge.

In the fuel vapor system shown in JP-2006-161795A, the fuel vapor concentration of the mixture gas which desorbed from the canister is detected in a detection passage connected to the purge passage prior to the purge. Hence, it is difficult to accurately detect the fuel vapor concentration of the mixture gas remaining in a downstream portion of the purge passage before the purge. After a large quantity of fuel vapor is adsorbed while the purge is stopped due to a fuel supply or a long-term parking, a fuel vapor detection concentration and an actual fuel vapor concentration of the mixture gas remaining in the purge passage deviate from each other. Thus, while the remaining mixture gas in the purge passage reaches the fuel injection position, it is relatively difficult to control the exhaust gas air-fuel ratio accurately.

SUMMARY OF THE INVENTION

The present invention is made in view of the above matters, and it is an object of the present invention to provide a fuel vapor treatment system which enables a large quantity purge and an accurate air-fuel ratio control.

According to the present invention, the fuel vapor treatment system includes a control means for performing a purge of a mixture gas into an internal combustion engine through a purge passage and controlling the purge based on a fuel vapor condition quantity detected by a detection means. The system further includes a learning means for learning a fuel vapor condition quantity of the mixture gas purged by the control means based on a driving condition quantity of the internal combustion engine. Under a condition that a difference between a learned condition quantity which is the fuel vapor condition quantity learned by the learning means at a previous purge and a detection condition quantity which is the fuel vapor condition quantity detected by the detection means after the previous purge is not less than a specified value, the control means controls the purge based on the learned condition quantity prior to a purge control based on the detection condition quantity.

The learned condition quantity which is learned based on the driving condition at the previous purge can be equal to the fuel vapor condition quantity of the mixture gas remaining in the purge passage after previous purge. When the difference between the learned condition value and the detection condition quantity detected after the previous purge, there is a deviation between the fuel vapor condition quantity of the mixture gas remaining in the purge passage before a present purge and the detection condition quantity.

According to the present invention, under a condition that the difference between the leaned condition quantity and the detection condition quantity is not less than the specified value, the purge control based on the learned condition quantity is performed prior to the purge control based on the detection condition quantity. Hence, at starting a present purge, a purge control reflecting the fuel vapor condition quantity of the mixture gas remaining in the purge passage can be performed. Thereby, the exhaust gas air-fuel ratio is well controlled. Furthermore, after the purge control based on the learned condition quantity, a large quantity of purge can be achieved by the purge control based on the detection condition quantity.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
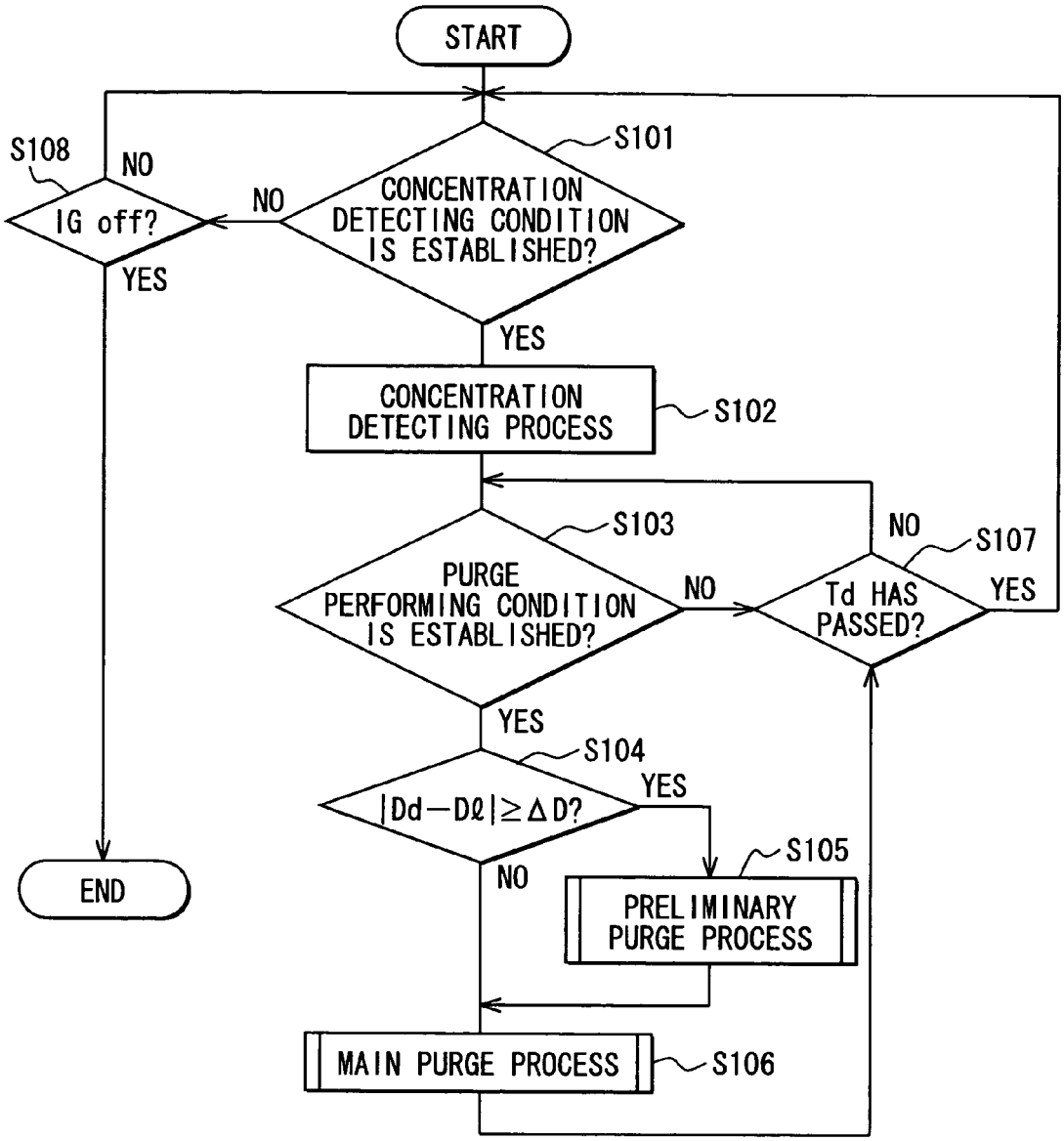
FIG. 1 is a flowchart showing an operation of a first embodiment.

Hereafter, a plurality of embodiments of the present invention are described. In each embodiment, the same parts and the components are indicated with the same reference numeral and the same description will not be reiterated.

First Embodiment

Figure 2:
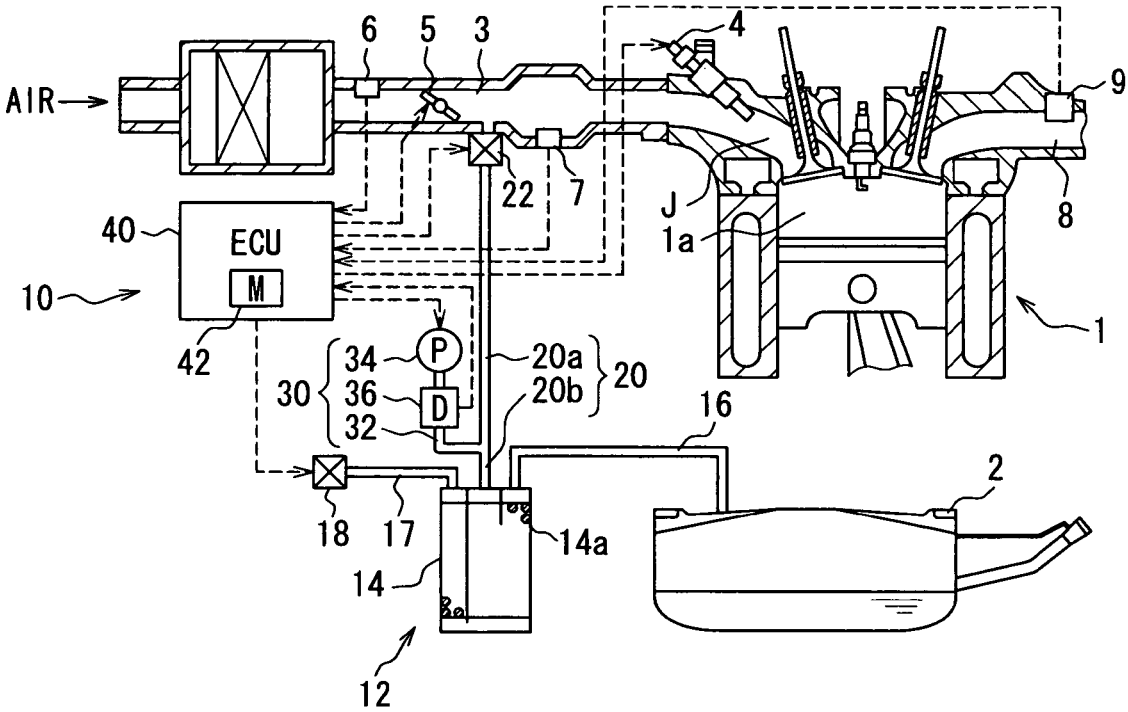
FIG. 2 is a view showing a structure of a fuel vapor treatment system according to a first embodiment.

FIG. 2 shows an internal combustion engine 1 of a vehicle to which a fuel vapor treatment system 10.

(Internal Combustion Engine)

The internal combustion engine 1 is a gasoline engine which generates power using gasoline accommodated in an interior of a fuel tank 2. An intake pipe 3 of the engine 1 is provided with a fuel injector 4 which injects fuel toward a fuel injection position J, a throttle valve 5 which controls an intake air, an intake air quantity sensor 6 which detects an intake air quantity Qa, and a intake air pressure sensor 7 which detects intake air pressure Pa. An exhaust pipe 8 of the engine 1 is provided with an air-fuel ratio sensor 9 which detects an exhaust gas air-fuel ratio.

(Fuel Vapor Treatment System)

The fuel vapor treatment system 10 is provided with a fuel vapor system 12, a detection system 30, and an electronic control unit (ECU) 40. The fuel vapor treatment system 10 treats fuel vapor which is combusted with injected fuel in the engine 1.

The fuel vapor system 12 is comprised of a canister 14, a tank passage 16, an atmosphere passage 17, a cutoff valve 18, a purge passage 20, and a purge control valve 22.

A canister 14 is connected to the fuel tank 2 through the tank passage 16. The canister 14 accommodates absorbent 14*a* such as activated charcoals. A fuel vapor generated in the fuel tank 2 flows into an interior of the canister 14 through the tank passage 16 and adsorbed by the absorbent 14*a*.

One end of the atmosphere passage 17 is opened to the atmosphere, and the other end of the atmosphere passage 17 is connected to the canister 14. The cutoff valve 18 is an electromagnetic On-Off valve and is provided to the atmosphere passage 17. When the cutoff valve 18 is opened, the canister 14 communicates to the atmosphere through the atmosphere passage 17.

The purge passage 20 connects between the canister 14 and the intake pipe 3. The purge passage 20 is connected to the intake pipe 3 at a downstream position of the throttle valve 5 and an upstream position of the fuel injection position J. The purge control valve 22 is an electromagnetic valve of which opening degree X is continuously changed from 0% to 100% or stepwise changed. In the present embodiment, the purge control valve 22 is provided at a connecting portion of the purge passage 20 to the intake pipe 3.

When the purge control valve 22 is opened, that is, when the opening degree X of the valve 22 is larger than 0%, negative pressure generated downstream of the throttle valve 5 is introduced into the canister 14 through the purge passage 20. The negative pressure desorbs the fuel vapor adsorbed in the absorbent 14*a*. Then, the desorbed fuel vapor is mixed with air. The mixture gas of the fuel vapor and the air flows through the purge passage 20 and is purged into the intake pipe 3. The mixture gas flows through the intake pipe 3 toward the fuel injection position J along with an intake air. The mixture gas reached the fuel injection position J is mixed with the fuel injected by the injector 4, and introduced into a cylinder 1*a* of the engine 1 to be combusted. Hence, in order to control the exhaust gas air-fuel ratio A/F in the exhaust pipe 8, it is important to control fuel injection quantity Fj and the purge quantity Qg.

When the purge control valve 22 is closed, that is, when the opening degree X of the valve is 0%, the purge passage 20 is interrupted from the intake pipe 3 so that negative pressure is not introduced into the canister 14 and the purge operation of the fuel vapor treatment system 10 is terminated. Hence, as long as a pump 34 is not operated to the canister 14, it is restricted to desorb the fuel vapor from the absorbent 14*a*.

The detection system 30 is comprised of a detection passage 32, a pump 34, and a detection circuit 36.

One end of the detection passage 32 is connected to the purge passage 20 at a vicinity of a connecting portion between the canister 14 and the purge passage 20. The purge passage 20 is comprised of a downstream portion 20*a* and an upstream portion 20*b* with respect to a connecting portion to the detection passage 32. In the present embodiment, it is downstream portion 20*a* between the connecting portion of the detection passage 32 and the purge control valve 22, and it is upstream portion 20*b* between the connecting portion of the detection passage 32 and the canister 14.

The pump 34 is an electric vane pump which is connected to the other end of the detection passage 32. When the pump 34 is operated, the detection passage 32 is decompressed.

The detection circuit 36 is provided in the detection passage 32 to detect a fuel vapor concentration D of the mixed gas introduced into the detection passage 32. The detection circuit 36 can be comprised of an orifice, a differential pressure sensor, and a switching valve.

When the cutoff valve 18 is opened and the purge control valve 22 is closed, the downstream portion 20*a* of the purge passage 20 is closed. When the pump 34 is operated, the interior of the canister 14 is decompressed through the detection passage 32 and the upper portion 20*b* of the purge passage 20. The fuel vapor adsorbed in the adsorbent 14*a* in the canister 14 is desorbed to be mixed with the air. The mixture gas of the fuel vapor and the air is introduced into the detection passage 32 through the upstream portion 20*b*. The detection circuit 36 detects the fuel vapor concentration D of the mixture gas in the detection passage 32.

The ECU 40 is comprised of a microcomputer including a memory 42. The ECU 40 is electrically connected to the valves 18, 22 of the fuel vapor system 12, the elements 34, 36 of the detection system 30, and the elements 4-7 and 9 of the engine 1. The ECU 40 controls the valves 18, 22, the pump 34, the injector 4 and the throttle valve 5 according to detection results of the detection circuit 36 and the sensors 6, 7, 9, a coolant temperature, an engine speed, an oil temperature, an accelerator position, and a condition of an ignition switch.

In a main purge process in which the cutoff valve 18 is opened and the purge control valve is opened, the ECU 40 conducts a feedback learning of the fuel vapor concentration D of the mixture gas which is actually purged into the engine 1 based on a driving condition quantity of the engine 1. Specifically, the fuel injection quantity Fj, the intake air quantity Qa, and the exhaust gas air-fuel ratio A/F are feedbacked to the ECU 40 as the driving condition quantity. The fuel injection quantity Fj, the intake air quantity Qa, the exhaust gas air-fuel ratio A/F, the purge quantity Qg, and the fuel vapor concentration D have a correlationship. In the present embodiment, the purge quantity Qg can be derived from the intake pressure Pa and the opening degree X of the purge control valve 22. Thus, the ECU 40 learns the fuel vapor concentration D from the above correlationship and stores the learned fuel vapor concentration Dl in the memory 42. In the present embodiment, the learned fuel vapor concentration Dl is updated every when the fuel vapor concentration D is computed.

(Control Operation)

Referring to FIG. 1, control operations performed by the ECU 40 is explained, hereinafter. The control process is started when an ignition switch is turned On.

In step S101, it is determined whether a concentration detecting condition is established. When a temperature of engine coolant, an engine speed, and a physical quantity representing a vehicle condition is within a predetermined range, the concentration detecting condition is established. The concentration detecting condition is established right after the engine 1 is started, and is stored in the memory 42.

When the answer is Yes in step S101, the procedure proceeds to step S102 in which the concentration detecting process is performed. In the concentration detecting process, the cutoff valve 18 is opened, the purge control valve 22 is closed, and the pump 34 is operated. Hence, the fuel vapor is desorbed from the adsorbent 14*a* and flows into the detection passage 32. The detection circuit 36 detects the concentration D of the fuel vapor. The detected concentration is stored in the memory 42 as a detection concentration Dd. The detection concentration Dd is updated every when the fuel vapor concentration D is detected.

After the concentration detecting process is finished, the procedure proceeds to step S103 in which it is determined whether a purge performing condition is established. When the purge performing condition is established, the temperature of the coolant, the engine speed, the vehicle condition is in a region which is different from the concentration detection condition. The purge performing condition is established when the coolant temperature is increased to finish the engine warming up, for example. And, the purge performing condition is stored in the memory 42.

When the answer is Yes in step S103, the procedure proceeds to step S104. In step S104, the detection concentration Dd is compared with the learned concentration Dl, and it is determined whether the difference between the concentration Dd and the concentration Dl is larger than the predetermined specified value AD. The specified value AD can be a fixed value stored in the memory or a variable value which varies according to the vehicle condition.

When the answer is Yes in step S104, the procedure proceeds to step S105 in which a preliminary purge process is performed. In the preliminary purge process, the cutoff valve 18 and the purge control valve 22 are opened, the purge of the mixture gas is controlled based on the learned concentration Dl, and the fuel injection quantity Fj is controlled along with the purge control. The fuel injection quantity Fj is controlled such that the exhaust gas air-fuel ratio A/F becomes a stoichiometric air-fuel ratio.

The purge control valve 22 is closed before starting step S105. During a period To from a purge starting timing by opening the purge control valve 22 until a timing at which the mixture gas reaches the fuel injection position J, only the intake air reaches the fuel injection position J. During the period To, the fuel injection quantity Fj is controlled such that the stoichiometric air-fuel ratio is obtained only by the fuel injection.

When the preliminary purge process is finished in step S105, or when the answer is No in step S104, the procedure proceeds to step S106 in which a main purge process is performed. In the main purge process, the cutoff valve 18 and the purge control valve 22 are opened, the purge of the mixture gas is controlled based on the detection concentration Dd stored in the memory 42, and the fuel injection quantity Fj is controlled according to the purge control. The control of the fuel injection quantity Fj is performed such that the exhaust gas air-fuel ratio A/F becomes the stoichiometric air-fuel ratio as well as the preliminary purge control.

In the present embodiment, in a case that the procedure proceeds from step S104 to step S106 through step S105, the purge control valve 22 is opened in step S106. In a case that the procedure proceeds to step S104 to step S106 directly, the purge control valve 22 is closed. In a case that the procedure proceeds from step S104 to S106 directly, during a period To from a time in which the purge control valve 22 is opened until the mixture gas reaches the fuel injection position J, the fuel injection quantity Fj is controlled such that the stoichiometric ratio is obtained only by the fuel injection.

As described above, when the differential concentration between the concentration Dd and the concentration Dl is larger than the specified value ΔD, the preliminary purge process is conducted based on the learned concentration Dl, and then the main purge process is conducted based on the detection concentration Dd. When the differential concentration between the concentration Dd and the concentration Dl is less than the specified value ΔD, only the main purge process is conducted based on the concentration Dd.

When the main purge process is finished in step S106 or when the answer is No in step S103, the procedure proceeds to step S107. In step S107, it is determined whether a predetermined time Td has passed from a later update timing of the concentration Dd and the concentration Dl. When the answer is Yes in step S107, the procedure goes back to step S101. When the answer is No in step S107, the procedure goes back to step S103. The predetermined time Td is established based on a variation with age or a required accuracy of the concentration Dd and the concentration Dl.

When the answer is No in step S101, the procedure proceeds to step S108.

In step S108, it is determined whether the ignition switch is turned Off. When the answer is No in step S108, the procedure goes back to step S101. When the answer is Yes in step S108, the procedure ends.

(Preliminary Purge Process)

Figure 3:
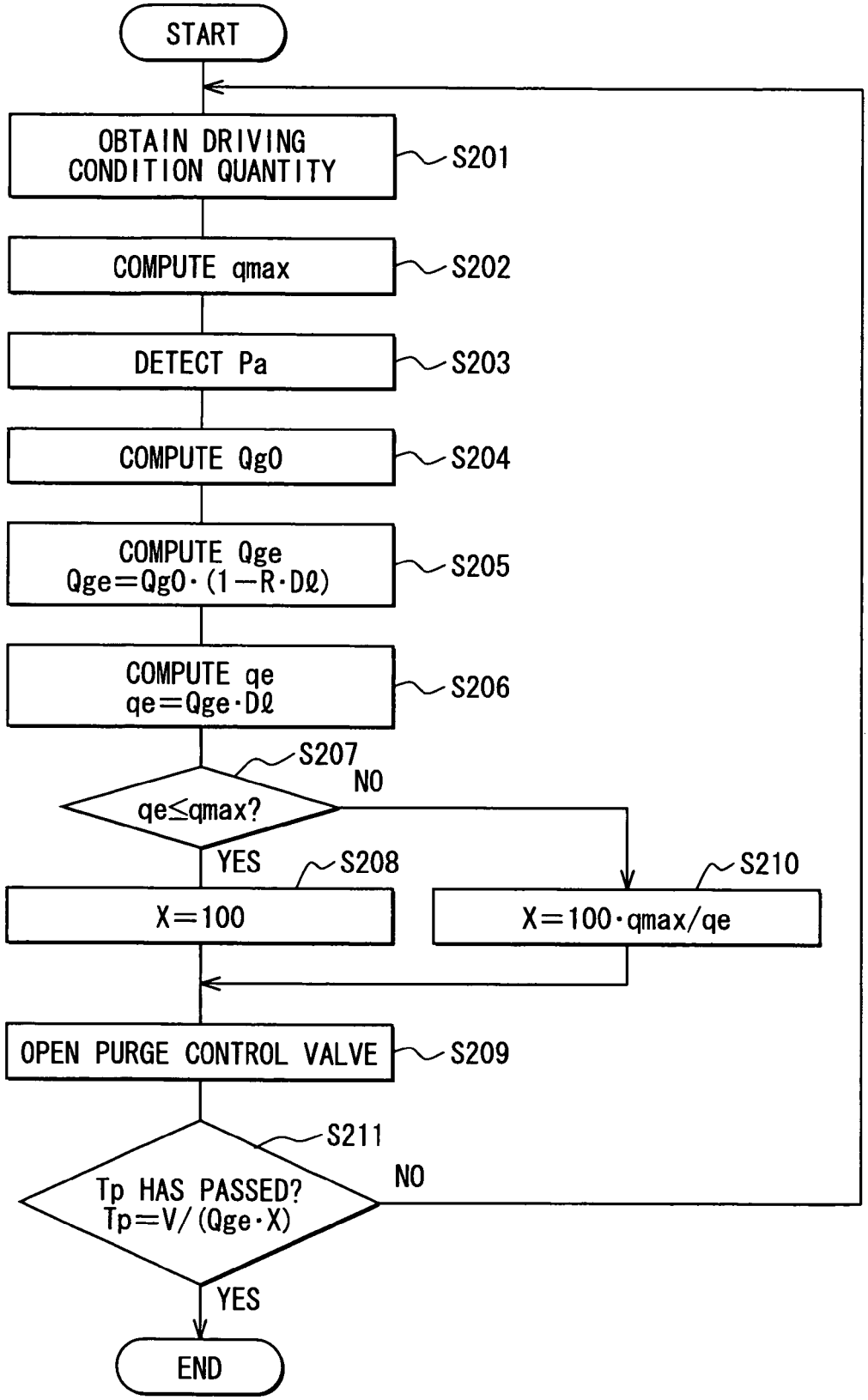
FIG. 3 is a flowchart showing a preliminary purge process according to the first embodiment.

Referring to FIG. 3, the preliminary purge process will be described in detail hereinafter.

In step S201, a position of the throttle valve 5 is obtained as a driving condition quantity of the engine 1. In step S202, a maximum fuel vapor quantity qmax is computed. The maximum fuel vapor quantity qmax is a permissible maximum value to get an appropriate exhaust gas air-fuel ratio AIF.

In step S203, an intake pressure Pa is detected by the intake pressure sensor 7. In step S204, a purge reference quantity Qg0 is computed according to the intake pressure Pa. When the fuel vapor concentration D of the mixture gas is 0%, that is, air is 100%, and the opening degree of the purge control valve is 100%, the purge quantity Qg is defined as the purge reference quantity Qg0.

In step S205, a purge expected quantity Qge is computed according to the following equation (1). The purge expected quantity Qge is a purge quantity Qg when the concentration D is equal to the learned concentration Dl and the opening degree X of the purge control valve 22 is 100%. In the equation (1), "Qg0" represents the purge reference quantity computed in step S204. "R" represents a reduction rate of the purge quantity Qg with respect to an increase of the fuel vapor concentration D. "R" is obtained by an experiment and is stored in the memory 42.

$$Qge = Qg0 \cdot (1 - R \cdot Dl) \quad (1)$$

In step S206, a fuel vapor expected quantity qe is computed according to a following equation (2). The fuel vapor expected quantity qe is a flow quantity of fuel vapor in the purge expected quantity Qge. In the equation (2), "Dl" is a learned concentration Dl stored in the memory 42. That is, the fuel vapor expected quantity qe is a value based on an updated learned concentration.

$$qe=Qge\cdot Dl \quad (2)$$

In step S207, it is determined whether the fuel vapor expected quantity qe is less than or equal to the maximum fuel vapor quantity qmax.

When the answer is Yes in step S207, the procedure proceeds to step S208 in which the opening degree X of the purge control valve 22 is set at 100%. In step S209, while the purge control valve 22 is opened at 100%, the mixture gas is purged. Hence, the purge quantity Qg is controlled so as to be the purge expected quantity Qge which is derived from the equation (1) based on the learned concentration Dl.

The learned concentration Dl is the newest value stored in the memory 42. In the present embodiment, the learned concentration Dl is a fuel vapor concentration D of the mixture gas which remains in the downstream portion 20*a* of the purge passage 20 after a previous main purge process is finished before the present preliminary purge process is started. Hence, in a case that the procedure proceeds through step S208, the purge quantity Qg can be controlled reflecting the fuel vapor concentration D in the downstream portion 20*a* of the purge passage 20.

When the answer is No in step S207, the procedure proceeds to step S210 in which the opening degree X of the purge control valve 22 is defined according to a following equation (3). In step S209, the purge control valve 22 is opened at the opening degree X, and the mixture gas is purged. Hence, when the fuel vapor expected quantity qe exceeds the maximum fuel vapor quantity qmax, the purge quantity Qg is controlled such that the maximum fuel vapor quantity qmax is realized. Thus, it is restricted that the exhaust gas air-fuel ratio A/F deviates from the stoichiometric ratio.

$$X=100\cdot q\max/qe \quad (3)$$

In step S211, it is determined whether a preliminary purge time Tp, which is represented by a following equation (4), has passed from a start timing of process in step S209. In the equation (4), 'V' represents a volume of the downstream portion 20*a*, "Qge" is the purge expected quantity computed in step S205, and "X" represents opening degree defined in step S208 and step S210. The equation (4) represents a time period during which the mixture gas remaining in the downstream portion 20*a* flows through the purge control valve 22.

$$Tp=V/(Qge\cdot X) \quad (4)$$

When the answer is No in step S211, the procedure goes back to step S201. When the answer is Yes in step S21, the preliminary purge process is finished. In the preliminary purge process, at least while the mixture gas remaining in the downstream portion 20*a* passes through the purge control valve 22, the control of the purge quantity Qg is maintained.

(Main Purge Process)

Figure 4:
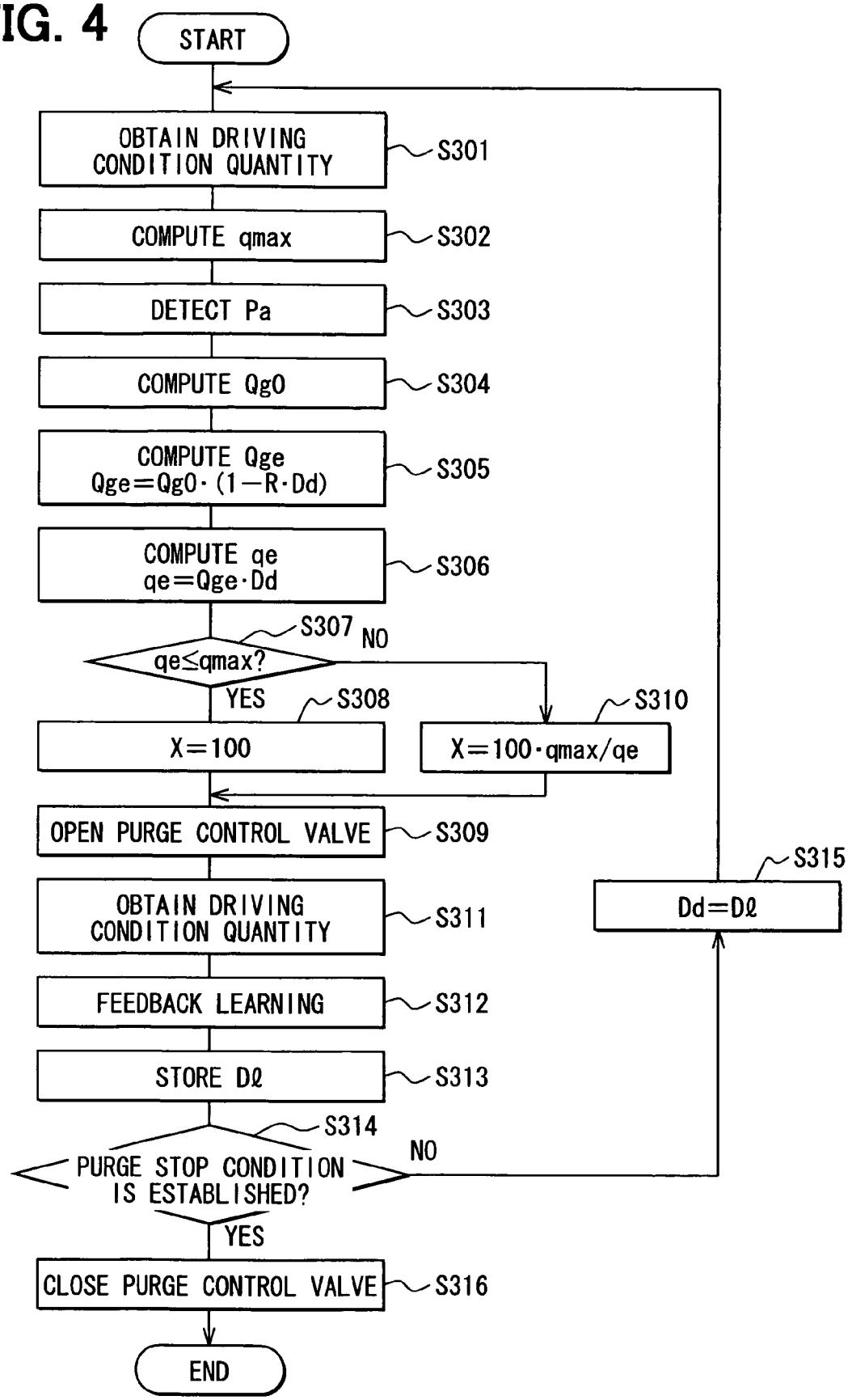
FIG. 4 is a flowchart showing a main purge process according to the first embodiment.

Referring to FIG. 4, the main purge process will be described hereinafter.

After steps S301-S304, which are the same as steps S201-S204, the procedure proceeds to step S305 and step S306 in which the purge expected quantity Qge and the fuel vapor expected quantity qe are respectively computed according to the following equations (5) and (6). In steps S305 and S306, "Dd" is a detected concentration which is stored in the memory 42, that is, "Dd" is the detected concentration right before main purge process is started.

$$Qge=Qg0\cdot(1-R\cdot Dd) \quad (5)$$

$$qe=Qge\cdot Dd \quad (6)$$

By performing steps S307-S309, which are substantially the same as the steps S207-S209, the purge quantity Qg is controlled to the quantity Qge which is obtained according to the equation (5) based on the updated detection concentration Dd. A process of step S310 is substantially the same as the process of step S210 of the preliminary purge process. Hence, when the fuel vapor expected quantity qe exceeds the maximum fuel vapor quantity qmax, the purge is conducted in step S309 such that the maximum fuel vapor quantity qmax is realized.

In step S311, the fuel injection quantity Fj, the intake air quantity Qa, and the exhaust gas air-fuel ratio A/F are obtained as the driving condition quantity of the engine 1. In step S312, the fuel vapor concentration D of the mixture gas purged in step S309 is feedback learned based on the driving condition quantity obtained in step S311. In step S313, the learned concentration Dl stored in the memory 42 is updated.

In step S314, it is determined whether a purge stop condition is established. The purge stop condition is established, when the vehicle condition quantity such as an engine speed, an accelerator position and the like is out of the above concentration detection condition and the purge conducting condition. The purge stop condition is established when the accelerator opening degree is less than a predetermined value to decrease the vehicle speed. The purge stop condition is stored in the memory 42.

When the answer is No in step S314, the procedure proceeds to step S315 in which the detected concentration Dd is rewritten into the learned concentration Dl, and then goes back to step S301. After going back to step S301, the purge control is performed based on the learned concentration Dl instead of the detection concentration Dd.

When the answer is Yes in step S314, the procedure proceeds to step S316 in which the purge control valve 22 is closed and the main purge process is finished. At the time of finishing the main purge process, the learned concentration Dl stored in the memory 42 is updated.

As described above, according to the first embodiment, when the differential concentration between the detection concentration Dd and the learned concentration Dl becomes larger than the specified value AD, the preliminary purge process based on the learned concentration Dl is performed before the main purge process based on the detection concentration Dd. According to the preliminary purge process, while the mixture gas remaining in the purge passage 20 after the previous main purge process passes through the purge control valve 22, the purge is controlled in such a manner as to reflect the learned concentration Dl, that is, the fuel vapor concentration D of the remaining mixture gas. Thus, when the detection concentration Dd deviates from the learned concentration Dl of the remaining mixture gas in a large amount, the purge control reflecting the concentration D and the fuel injection Fj reduces the deviation of the exhaust gas air-fuel ratio with respect to the stoichiometric ratio.

Furthermore, in the first embodiment, after the preliminary purge process is performed, or when the differential concentration between the detection concentration Dd and the learned concentration Dl is less than the specified value AD, the mixture gas is continuously purged by the ordinary main purge process until the purge stop condition is established. Thus, even in a limited time period, a large amount of mixture gas can be purged.

Second Embodiment

Figure 5:
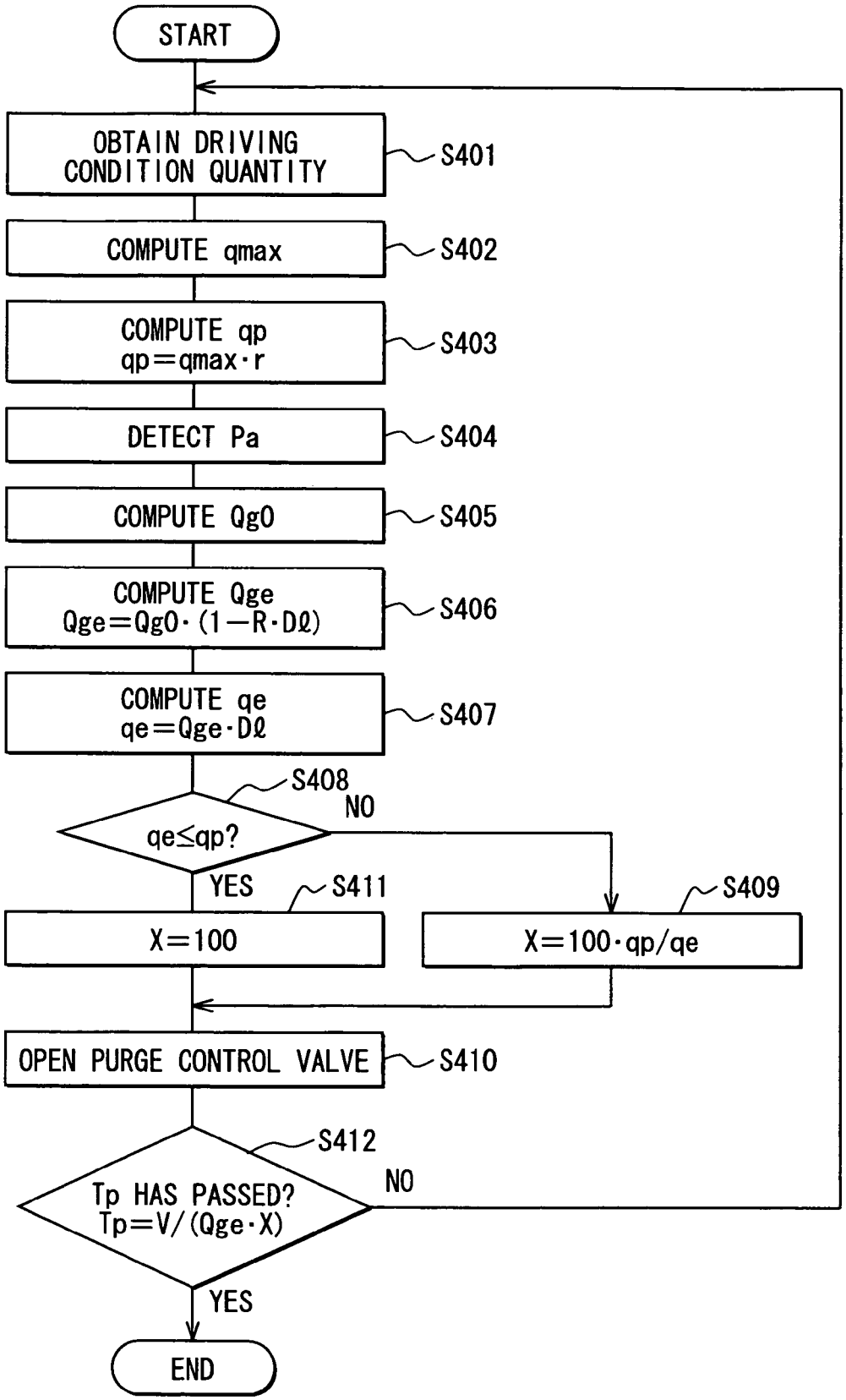
FIG. 5 is a flowchart showing a preliminary purge process according to a second embodiment.

As shown in FIG. 5, a second embodiment is a modification of the first embodiment. A preliminary purge process of the second embodiment is different from the preliminary purge process of the first embodiment.

In the preliminary purge process of the second embodiment, after steps S401 and S402 which are substantially the same as steps S201 and S202, step S403 is performed. In step S403, a fuel vapor permissible quantity qp is computed according to a following equation (7) under a limitation of the purge quantity Qg. In the equation (7), "qmax" is the maximum fuel vapor quantity qmax computed in step S402, and "r" is a limitation ratio of the purge quantity Qg. That is, the fuel vapor permissible quantity qp is obtained by reducing the maximum fuel vapor quantity qmax with the limitation ratio r. The limitation ratio "r" can be a fixed value stored in the memory 42 or a variable value which varies according to the driving condition quantity or the differential concentration between the concentration Dd and the concentration Dl.

$$qp=q\max\cdot r \tag{7}$$

After steps S404-S407 which are substantially the same as steps S203-S206 in the first embodiment, steps S408-S411 are performed.

In step S408, it is determined whether the fuel vapor expected quantity qe is not more than the fuel vapor permissible quantity qp.

When the answer is No in step S408, the procedure proceeds to step S409 in which the opening degree X of the purge control valve 22 is defined according to a following equation (8). In step S410, the purge valve 22 is opened at the opening degree X to purge the mixture gas. Therefore, when the fuel vapor expected quantity qe exceeds the fuel vapor permissible quantity qp, the purge quantity Qg is controlled such that the fuel vapor permissible quantity qp is realized.

$$X=100\cdot qp/qe \tag{8}$$

When the answer is Yes in step S408, the procedure proceeds to step S411 in which the opening degree X of the purge control valve 22 is set at 100%. In step S410, the purge control valve 22 is opened at 100% to purge the mixture gas. Therefore, the purge quantity Qg is controlled according to the learned concentration Dl that is equal to the concentration D of the mixture gas remaining in the downstream portion 20*a*. In this case, the purge quantity Qg is controlled to realize the fuel vapor expected quantity qe which is less than the fuel vapor permissible quantity qp. The purge quantity Qg can be more restricted than the case in which the process in step S409 is performed.

A process of step S412 is substantially the same as the process of step S211 in the first embodiment. During a preliminary purge period Tp, step S401 and the following steps are repeatedly performed. When the preliminary purge time period Tp has passed, the preliminary purge process is finished.

As described above, according to the second embodiment, when the differential concentration between the detection concentration Dd and the learned concentration Dl is larger than the specified value ΔD, the preliminary purge process restricting the purge quantity Qg is performed prior to the main purge process based on the detected concentration Dd. According to the preliminary purge process, when the detection concentration Dd deviates from the learned concentration Dl that is a fuel vapor concentration D of the mixture gas remaining in the purge passage 20 after main purge process, a reached fuel vapor quantity can be reduced while the remaining mixture gas passes through the purge control valve 22. Therefore, the deviation of the exhaust gas air-fuel ratio A/F from the stoichiometric air-fuel ratio can be reduced by the purge control reducing the fuel vapor and the fuel injection quantity Fj.

Furthermore, when the quantity qe lower than the permissible quantity qp is expected based on the learned concentration D, the purge quantity Qg is controlled in such a manner as to reflect the fuel vapor concentration D of the mixture gas remaining in the downstream portion 20*a*. Therefore, the deviation of the exhaust gas air-fuel ratio A/F from the stoichiometric air-fuel ratio can be reduced.

Third Embodiment

Figure 6:
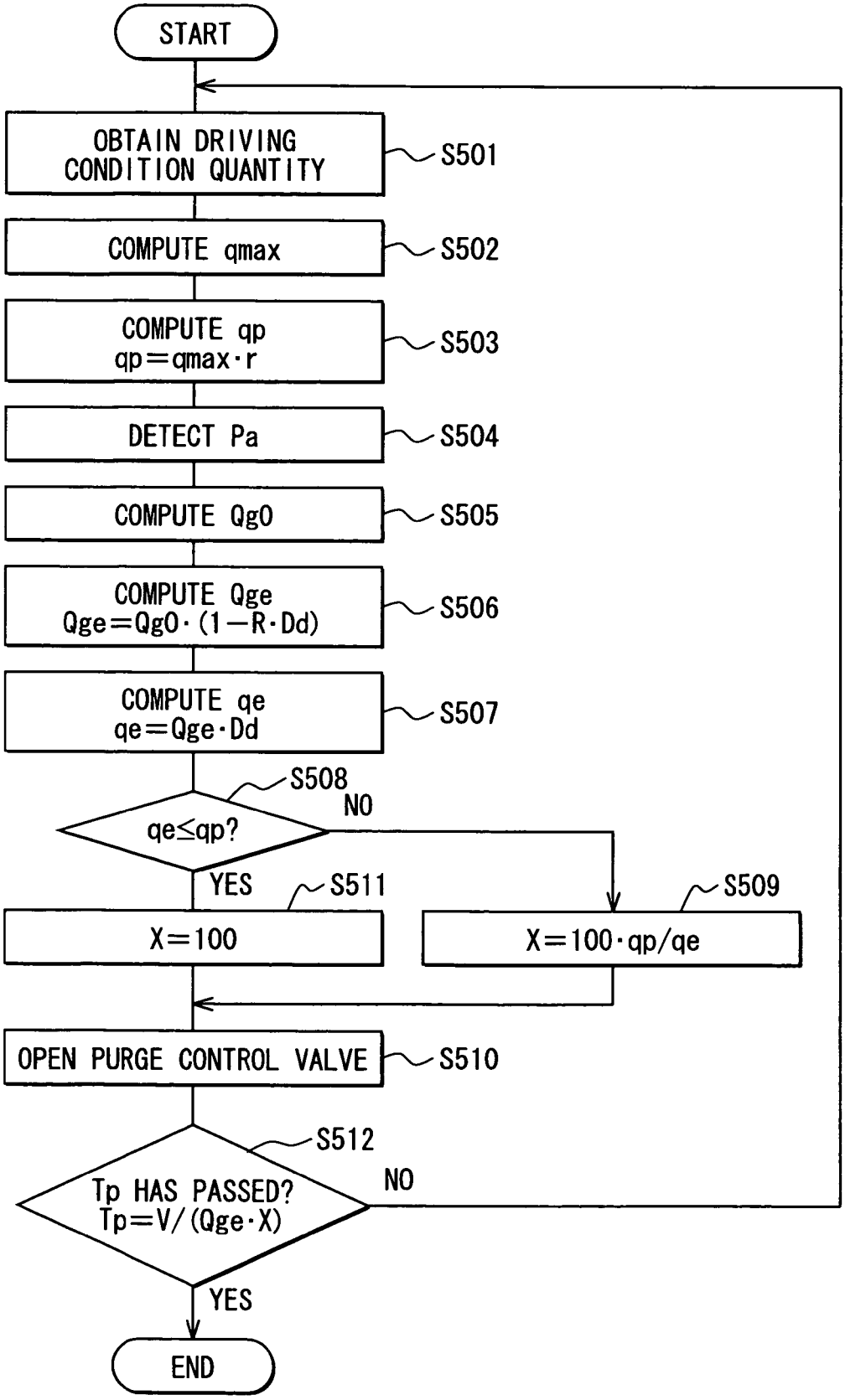
FIG. 6 is a flowchart showing a preliminary purge process according to a third embodiment.

As shown in FIG. 6, a third embodiment is a modification of the second embodiment. The process of the preliminary purge process is different from the second embodiment.

In the preliminary purge process of the third embodiment, steps S501-S505 are substantially the same as steps S401-S405 in the second embodiment. In steps S506 and S507, the purge expected quantity Qge and the fuel vapor expected quantity qe are computed according to the equations (5), (6). That is, the purge expected quantity Qge and fuel vapor expected quantity qe are computed based on the detection concentration Dd.

By performing steps S508-S511 which are substantially the same as steps S408-S411 of the second embodiment, the purge quantity Qg can be controlled. Therefore, according to the third embodiment, the deviation of the exhaust gas air-fuel ratio A/F from the stoichiometric air-fuel ratio can be reduced.

Fourth Embodiment

Figure 7:
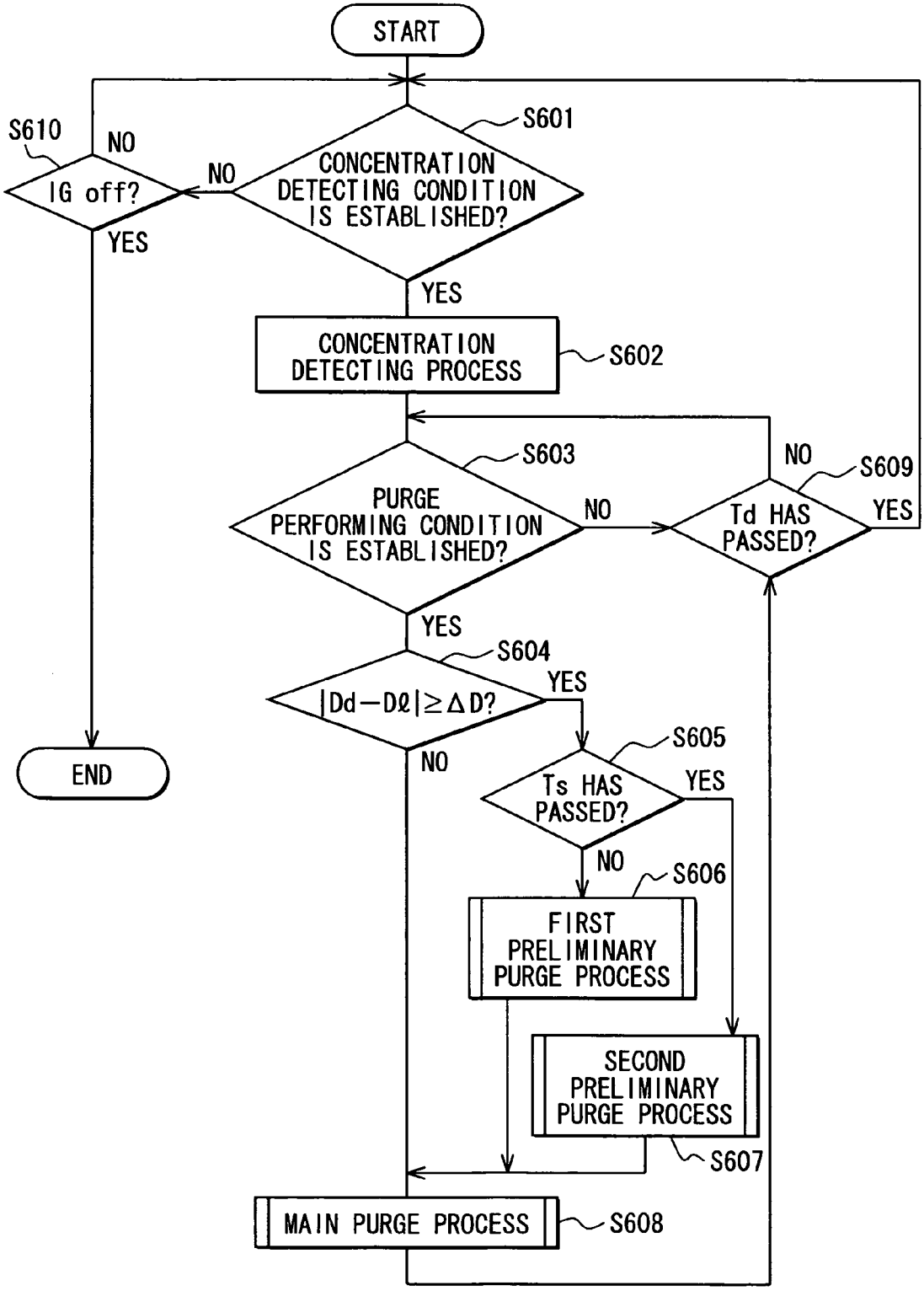
FIG. 7 is a flowchart showing an operation of a fourth embodiment.

As shown in FIG. 7, a fourth embodiment is a modification in which the preliminary purge processes of the first embodiment and the second embodiment are selectively performed.

In FIG. 7, steps S601-S604 are substantially the same as steps S101-S104. After performing steps S601-S604, the procedure proceeds to step S605.

When the answer is Yes in step S604, the procedure proceeds to step S605 in which it is determined whether a predetermined specified time Ts has passed since a previous main purge process.

When the answer is No in step S605, the procedure proceeds to step S606 in which a first preliminary purge process which is similar to the preliminary purge process of the first embodiment is performed. Therefore, the advantages of the preliminary purge process of the first embodiment can be obtained.

When the answer is Yes, the procedure proceeds to step S607 in which a second preliminary purge process which is similar to the preliminary purge process of the second embodiment is performed. Therefore, the advantages of the preliminary purge process of the second embodiment can be obtained.

In step S608 which is substantially the same as step S106 of the first embodiment, the main purge process is performed. Steps S609 and S610 are substantially the same as steps S107 and S108 respectively.

According to the fourth embodiment, when a purge stop period is less than the specified period Ts in a case that the vehicle is stopped for filling fuel, the fuel concentration D of the mixture gas remaining in the purge passage 20 hardly deviates from the learned concentration Dl. Therefore, the purge quantity Qg is controlled based on the learned concentration Dl by the first preliminary purge process, whereby the exhaust gas air-fuel ratio A/F is made appropriate.

When the purge stop period is longer than the specified period Ts, a concentration gradient may arise in the purge passage 20 in a vertical direction, or fuel vapor may be desorbed spontaneously from the adsorbent 14*a*. There is a possibility that the fuel vapor concentration D of the remaining mixture gas may deviate from the detection concentration Dd as well as the learned concentration Dl. Therefore, the purge quantity Qg is controlled by the second preliminary purge process such that the exhaust gas air-fuel ratio A/F can be made appropriate.

Other Embodiment

The present invention is not limited to the above embodiments, and can be applied to various embodiments.

Figure 8:
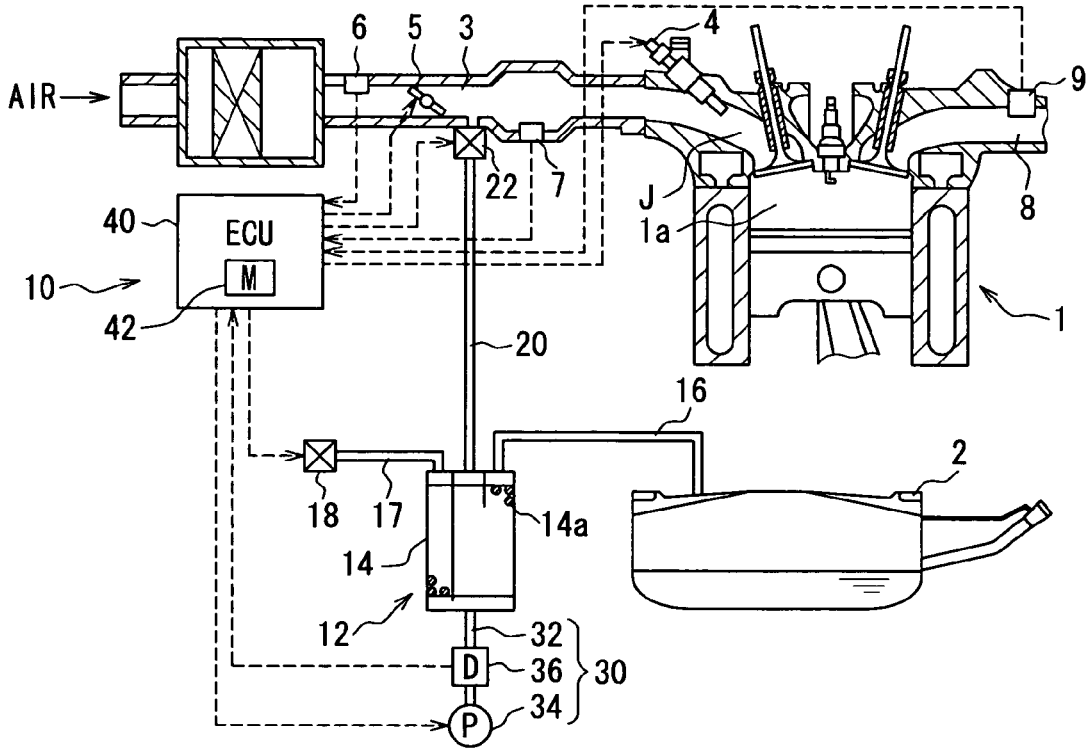
FIG. 8 is a view showing a structure of a fuel vapor treatment system according to a modification of FIG. 2.

For example, in the first to fourth embodiments, the detection passage 32 provided with the detection circuit 36 can be connected to the canister 14, as shown in FIG. 8. In this embodiment, the purge passage 20 is positioned downstream of the canister 14 and upstream of the purge control valve 22. Hence, the learned concentration Dl becomes equal to the fuel vapor concentration D of the mixture gas remaining in the purge passage 20 during a period from finishing the main purge process to starting the preliminary purge process. Hence, in this embodiment, "V" in the equation (4) represents volume of the purge passage 20. Furthermore, the variable pump 34 of which discharge direction is variable can be used. The purge valve 22 is opened and the interior of the canister 14 is pressurized so that the purge quantity Qg of the mixture gas is increased.

Besides, in detection system 30 of the first to fourth embodiments, another gas flow generating means can be used instead of the pump 34. For example, an accumulator can be used. The accumulator accumulates negative pressure of the intake pipe 3 and applies the accumulated negative pressure to the detection passage 32.

Figure 9:
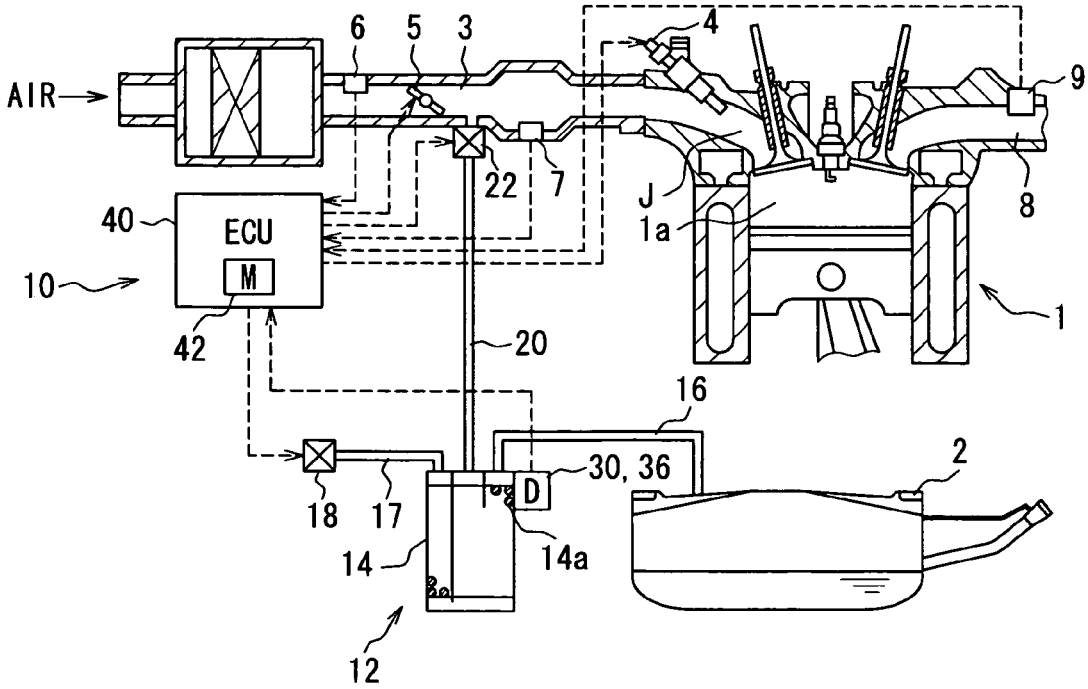
FIG. 9 is a view showing a structure of a fuel vapor treatment system according to another modification of FIG. 2.

As shown in FIG. 9, the detection circuit 36 including a concentration sensor can be provided to the canister 14 directly. Also in this embodiment, the fuel vapor concentration D of the mixture gas containing in the purge passage 20 becomes equal to the learned concentration Dl. Hence, "V" in the equation (4) represents volume of the purge passage 20.

In the fourth embodiment, the first preliminary purge process and the second preliminary process can be selected based on whether a fuel feeding operation exists or whether a turning off operation of the ignition switch exists. The second preliminary purge process of the fourth embodiment can be conducted according to the preliminary purge process of the third embodiment.

What is claimed is:

1. A fuel vapor treatment system treating a fuel vapor which is combusted with injected fuel of an internal combustion engine, comprising:

a canister containing an adsorbent which temporarily adsorbs fuel vapor generated in a fuel tank;

a detection means for detecting a fuel vapor condition quantity of a mixture gas of air and the fuel vapor desorbed from the adsorbent;

a purge passage for introducing the mixture gas into the internal combustion engine;

a control means for performing a purge of the mixture gas into the internal combustion engine through the purge passage and controlling the purge based on the fuel vapor condition quantity detected by the detection means; and a learning means for learning a fuel vapor condition quantity of the mixture gas purged by the control means based on a driving condition quantity of the internal combustion engine; wherein under a condition that a difference between a learned condition quantity which is the fuel vapor condition quantity learned by the learning means at a previous purge and a detection condition quantity which is the fuel vapor condition quantity detected by the detection means after the previous purge is not less than a specified value, the control means controls the purge based on the learned condition quantity prior to a purge control based on the detection condition quantity.

2. A fuel vapor treatment system according to claim 1, wherein under a condition that the difference is less than the specified value, the control means skips the purge control based on the learned condition quantity and performs the purge control based on the detection condition quantity.

3. A fuel vapor treatment system according to claim 1, further comprising a fuel vapor system including the canister and the purge passage through which the mixture gas flows and being connected to the detection means which detects the fuel vapor condition quantity of the mixture gas, wherein the control means includes a purge control valve provided in the purge passage for controlling a purge quantity of the mixture gas by adjusting its opening degree, and the control means continues the purge control based on the learned condition quantity while the mixture gas remaining in the purge passage downstream of a connecting portion to the detection means of the fuel vapor system passes through the purge control valve.

4. A fuel vapor treatment system treating a fuel vapor which is combusted with injected fuel of an internal combustion engine, comprising:

a canister containing an adsorbent which temporarily adsorbs fuel vapor generated in a fuel tank;

a detection means for detecting a fuel vapor condition quantity of a mixture gas of air and the fuel vapor desorbed from the adsorbent;

a purge passage for introducing the mixture gas into the internal combustion engine;

a control means for performing a purge of the mixture gas into the internal combustion engine through the purge passage and controlling the purge based on the fuel vapor condition quantity detected by the detection means; and a learning means for learning a fuel vapor condition quantity of the mixture gas purged by the control means based on a driving condition quantity of the internal combustion engine; wherein under a condition that a difference between a learned condition quantity which is the fuel vapor condition quantity learned by the learning means at a previous purge and a detection condition quantity which is the fuel vapor condition quantity detected by the detection means after the previous purge is not less than a specified value, the control means controls the purge by restricting a purge quantity of the mixture gas prior to a purge control based on the detection condition quantity.

5. A fuel vapor treatment system according to claim 4, wherein under a condition that the difference is less than the specified value, the control means skips the purge control restricting the purge quantity and performs the purge control based on the detection condition quantity.

6. A fuel vapor treatment system according to claim 4, further comprising a fuel vapor system including the canister and the purge passage through which the mixture gas flows and being connected to the detection means which detects the fuel vapor condition quantity of the mixture gas, wherein the control means includes a purge control valve provided in the purge passage for controlling a purge quantity of the mixture gas by adjusting its opening degree, and the control means continues the purge control restricting the purge quantity while the mixture gas remaining in the purge passage downstream of a connecting portion to the detection means of the fuel vapor system passes through the purge control valve.

7. A fuel vapor treatment system according to claim 4, wherein the control means performs the purge control restricting the purge quantity based on the detection condition quantity.

8. A fuel vapor treatment system according to claim 4, wherein the control means performs the purge control restricting the purge quantity based on the learned condition quantity.

9. A fuel vapor treatment system according to claim 8, wherein under a condition that the difference is not less than the specified value, and a fuel vapor expected quantity based on the learned condition quantity exceeds a fuel vapor permissible quantity with a restriction of the purge quantity, the control means performs the purge control in which the purge quantity is restricted so as to realize the fuel vapor permissible quantity prior to the purge control based on the detection condition quantity, and under a condition that the difference is not less than the specified value and the fuel vapor expected quantity is not more than the fuel vapor permissible quantity, the control means performs the purge control in which the purge quantity is controlled so as to realize the fuel vapor expected quantity prior to the purge control based on the detection condition quantity.

10. A fuel vapor treatment system according to claim 4, wherein under a condition that the difference is not less than the specified value and a purge stop period is longer than a specified period, the control means performs the purge control restricting the purge quantity prior to the purge control based on the detection condition quantity, and under a condition that the difference is not less than the specified value and the purge stop period is less than the specified period, the control means performs the purge control based on the learned condition quantity prior to the purge control based on the detection condition quantity.

11. A fuel vapor treatment system according to claim 1, wherein the fuel vapor condition quantity detected by the detection means and the fuel vapor quantity learned by the learning means are fuel vapor concentration of the mixture gas.

12. A fuel vapor treatment system according to claim 1, wherein the driving condition quantity includes a fuel injection quantity, an intake air flow rate, and an exhaust gas air-fuel ratio, and the learning means learns the fuel vapor concentration of the mixture gas which is purged by the control means based on the driving condition quantity.

13. A fuel vapor treatment system according to claim 1, wherein the control means controls the purge based on the fuel vapor condition quantity learned by the learning means after performing the purge control based on the detection condition quantity.

14. A fuel vapor treatment system according to claim 1, wherein the control means controls a fuel injection quantity along with the purge control.

* * * * *